US005210880A

United States Patent [19]

Yale

[11] Patent Number: 5,210,880

[45] Date of Patent: May 18, 1993

[54] DISPOSABLE PROTECTIVE OVERGLOVES

[76] Inventor: Joyce K. Yale, 428 31st St., Hermosa Beach, Calif. 90254-2135

[21] Appl. No.: 749,174

[22] Filed: Aug. 23, 1991

[51] Int. Cl.[5] ..... A41D 19/00

[52] U.S. Cl. ..... 2/159; 2/162; 2/163

[58] Field of Search ..... 2/159, 161 R, 162, 163, 2/168, 169, 158, 160, 16

[56] References Cited

U.S. PATENT DOCUMENTS

| | | | |
|---|---|---|---|
| Re. 25,675 | 11/1964 | DuBonnett | 2/159 |
| 4,034,853 | 7/1977 | Smith | 2/169 X |
| 4,071,921 | 2/1978 | Jury | 2/158 X |
| 4,928,322 | 5/1990 | Bradfield | 2/163 X |
| 5,020,160 | 6/1991 | Cano | 2/161 R X |
| 5,025,503 | 6/1991 | O'Brien | 2/163 |

FOREIGN PATENT DOCUMENTS

| | | | |
|---|---|---|---|
| 662266 | 4/1965 | Belgium | 2/169 |
| 1100452 | 5/1981 | Canada | 2/159 |
| 429572 | 10/1962 | Switzerland | 2/169 |
| 2164540 | 3/1986 | United Kingdom | 2/159 |
| 8900385 | 1/1989 | World Int. Prop. O. | 2/159 |

*Primary Examiner*—Clifford D. Crowder
*Assistant Examiner*—Sara M. Current

[57] ABSTRACT

This invention relates to devices used to maintain an aseptic relationship with the patient being treated and the environment of the treatment. This invention is a pair of thin, large, transparent, overgloves with a patch of adhesive on the digit portion of the palm side of the left and right glove. The gloves come paired, with a cut out area above the wrist on the back of the hand thereby separating the back side from the palm side for ease of entry. These overgloves are disposable.

1 Claim, 1 Drawing Sheet

DISPOSABLE PROTECTIVE OVERGLOVES

BACKGROUND

This invention relates generally to devices used in the human healthcare service intended to eliminate cross contamination of patient to patient, and cross contamination of healthcare workers to patient. This devise provides a protective cover of the tightly gloved hand when the worker needs to handle non-sterile items before terminating sterile procedures on the patient, such as opening drawers, writing prescriptions, making notes on charts, answering telephones, and many other office or operatory expected or unexpected motions.

A common problem with preventing contamination of patients, operators, and equipment, is that the healthcare worker is using tight-fitting latex type gloves. When the healthcare worker must touch equipment of any sort, the gloves must be removed so the microbes of the patient are not placed upon said equipment. Likewise, the microbes on the equipment from others handling it, are not to be transferred to the patient. The healthcare worker could remove the tight-fitting gloves with each non-patient movement, then reverse them, as they are pulled off inside out, but that is very time consuming and frustrating. Unfortunately, and in spite of OSHA regulations, cross contamination occurs regularly because it is too difficult to be removing and replacing gloves and many workers are not schooled enough to be aware that they are spreading disease by merely picking up a telephone or a pencil or opening a drawer with their gloved hand, then returning to the patient. Non-gloved workers are then contaminated when they pick up the pen or telephone or open a drawer.

The need for this type of protection is most notable in the dental office where the healthcare worker is in and out of the patient's mouth throughout the entire procedure, whatever the procedure may be. Drawers are opened, jars and tubes are opened, notes are written on charts, x-rays are put in the mouth then machines are moved into place and buttons are touched, and all the while, gloved hands return to the mouth. Microbes from each and every patient are left on pencils and pens, charts, jars, tubes, drawers, cabinets, x-ray machines and very seldom if ever, are these items and areas disinfected.

DESCRIPTION OF THE PRIOR ART

There are thin, over-sized gloves used in food service. These could be used as a barrier between patient and object. The problem with them however, is that you have to contaminate them in order to put them on. That is, a gloved hand must pick them up thus touching their exteriors and thereby contaminating them with the patients microbes and eliminating the barrier being sought. Also, they cannot be sanitarily set aside for reuse during work on the same patient.

An existing prior patent which is an overglove and made of thin plastic was designed to keep women's dress glove clean and could not be used in a healthcare situation: WOMAN'S OVERGLOVE OR THE LIKE, U.S. Pat. No. 2,972,748 patented Feb. 28, 1961 (class 2/46).

Another prior art only in that it is made of thin plastic and is disposable is a three fingered food handler's glove: PROTECTIVE COVER FOR THE HANDS, U.S. Pat. No. 2,773,264 patented Dec. 11, 1956 (class 2/159).

Another prior art only in that it is disposable is a plastic glove to keep one's hands clean when pumping gas: DISPOSABLE GLOVE OR MITT FOR SELF-SERVICE GASOLINE U.S. Pat. No. 4,745,635 patented May 24, 1988 (class 2/161R).

Another prior art similar to the above mentioned prior art is by the same inventor: DISPOSABLE GLOVE OR MITT FOR SELF-SERVICE GASOLINE AND FROZEN FOOD HANDLER, U.S. Pat. No. 4,918,755 patented Apr. 24, 1990 (class 2/161R).

The new and novel features of the present invention are that these overgloves can be put on without touching their exteriors, and that they can be stuck up when not in use while the healthcare worker is attending the same patient's person.

SUMMARY

An object of the present invention is to provide a protective overglove for healthcare workers to use to maintain a patient work area free from contamination caused by the patient's microbes being placed on objects handled by the healthcare worker which are subsequently able to be transmitted from one patient to another, as the work area is occupied by many patients, one after another.

Another object of the present invention is to provide a protective overglove for the healthcare worker to prevent patient contamination of objects in order to save the healthcare worker valuable time that is spent in having to thoroughly disinfect the work area after each patient is dismissed.

A further object of the present invention is to provide a protective overglove for the healthcare worker that the patient can see is maintaining the protective barrier which prevents each patient from coming into contact with the previous patient's microbes via the equipment etc.

A still further object of the present invention is to provide a protective overglove that the healthcare worker can slip on easily without contaminating the exteriors by the tight fitting, patient glove that is being worn.

A still further object of the present invention is to provide a protective overglove that the healthcare worker can use repeatedly and conveniently with the same patient and still continue to maintain said overglove uncontaminated on the exterior.

Another object of the present invention is to provide a protective overglove that the healthcare worker disposes when treatment with each patient ends.

This invention is unique in that the gloves will come paired, stuck together by gentle adhesive located on the finger portion of the palm side, with a cut out above the wrist on the back or wrist side of the glove. This cut out will allow the healthcare worker to slip the patient-contaminated gloved hand into this glove and pull out the pair of overgloves, then slip the other patient-contaminated gloved hand into the other overglove. Since the adhesive is gentle, the overgloves separate from each other with ease. The plastic of the overgloves is thin to allow the healthcare worker to retain tactile sense. By slipping on the overgloves during a patient's treatment, the healthcare worker is free to touch anything in the work area where the patient is being treated without contaminating other objects with the patient's microbes, can then stick the overgloves upon any surface and can return to the patient still wearing the tight fitting patient gloves without having added any environmental microbes to the patient, thereby maintaining the protective barrier desired. When it is time to return to the patient, the healthcare worker merely places hands on the wall, counter top, desk, or wherever, slips out of the overgloves which will stick to the surface and remain in place until they may be needed again. The healthcare worker may return to the stuck overgloves over and over again, slip them on easily without ever touching and contaminating them externally, and do whatever non-patient chore that is necessary. The operator will dispose of each pair of overgloves upon dismissing the patient as the insides of the overgloves will be contaminated with each patient's microbes. This invention would provide that important protective barrier that keeps each patient from being infected by the microbes of all other patients and still allows the healthcare worker to function efficiently and safely and follow all the guidelines prescribed by OSHA.

Further objects and advantages of the invention will be apparent from the drawings wherein:

DESCRIPTION OF THE PREFERRED EMBODIMENT

Figure 1:
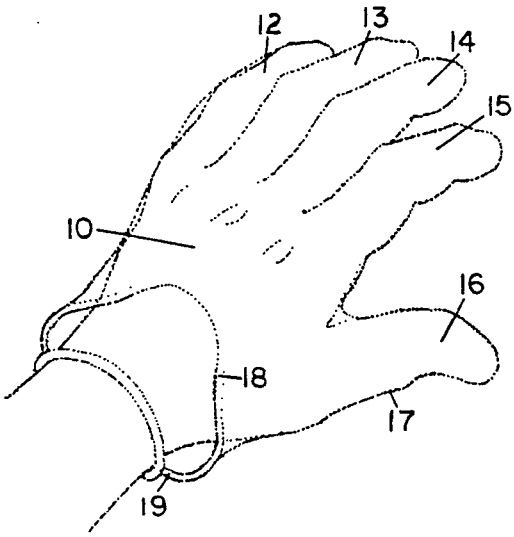
FIG. 1 is a view of the back or wrist side of the present invention.

FIG. 1 shows the present invention applied to a common glove shape made of thin transparent plastic type material and sized sufficiently large to be used and known as an overglove. There is a back or wrist side 10 and a palm side 11 with a digit portion 12, 13, 14, 15, 16; the glove being sealed at it periphery 17. The wrist side 10 has a shorter bottom length 18 than the bottom length 19 of the palm side 11. The shorter bottom length 18 of the wrist side 10 is cut in a half moon shape to allow the user's gloved hand easy access. This is the only opening of the overglove so it will be waterproof.

Figure 2:
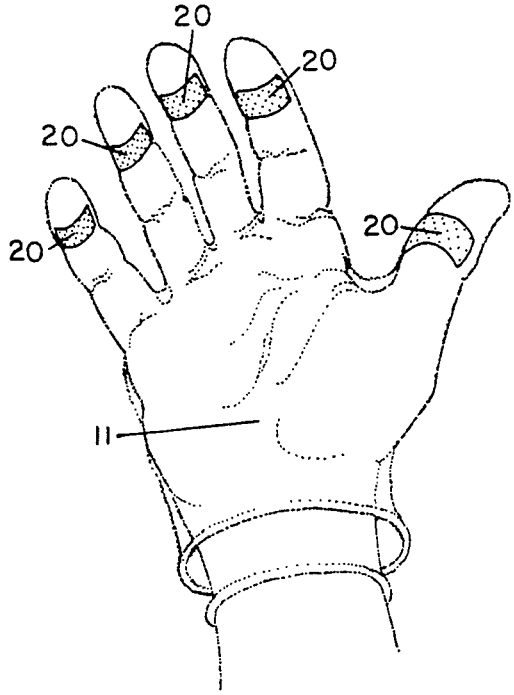
FIG. 2 is a view of the palm side of the present invention.

FIG. 2 shows the palm side 11 of the present invention is shown with a strip of adhesive 20 across the digit portion.

Figure 3:
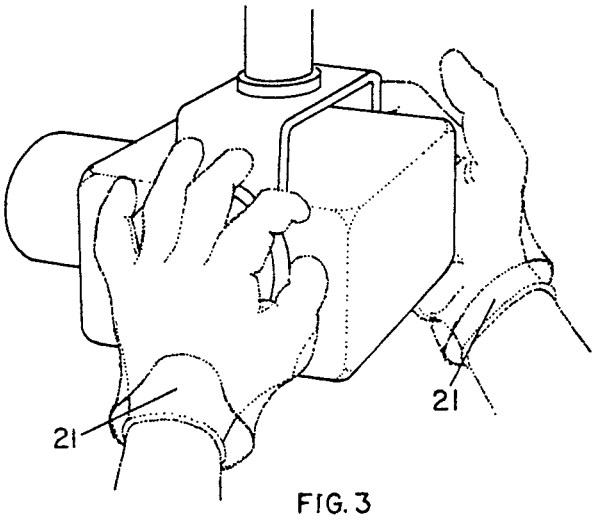
FIG. 3 is a view of the present invention being worn by a gloved health care worker.

FIG. 3 shows the present invention being worn over the gloved hands 21 of a health care worker as a piece of equipment is being used on the patient. This equipment is not contaminated by the health care worker's patient gloves which can be seen inside the overgloves.

Figure 4:
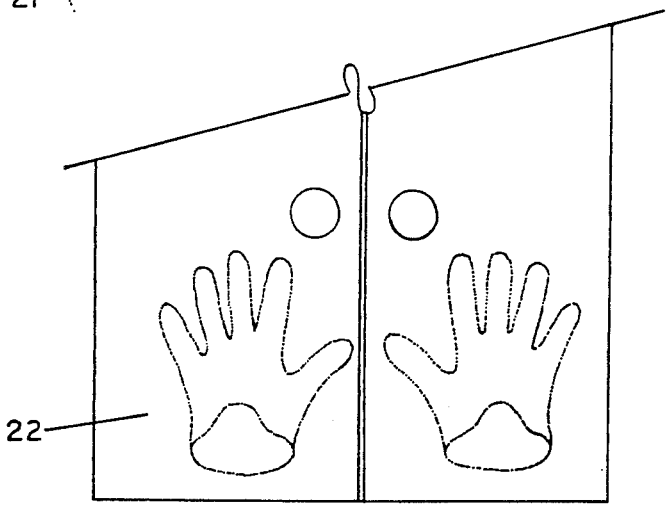
FIG. 4 is a view of the present invention waiting for further use.

FIG. 4 shows the present invention hanging on cabinet doors 22 as the health care worker is treating the patient directly. The ability to stick to a surface allows the health care worker to enter and depart the overgloves at will, quickly, easily, and without touching, and thereby contaminating, their exterior portion.

I claim:

1. A transparent protective overglove for use over a hand wearing a tight fitting patient glove comprising:

an overglove made from thin plastic material having a back side, a palm side, a digit portion having five finger portions, a wrist portion and interior and exterior surfaces, said overglove being dimensioned to be substantially larger than a gloved hand to be covered by the overglove, said overglove having a first length extending from a tip of the digit portion to the wrist on the back side of the overglove and having a second length extending from a tip of the digit portion to the wrist on the palm side of the overglove, and wherein said first length is less than said second length so that a wearer's hand may readily enter the wrist of the glove; and a plurality of adhesive strips, wherein each strip is located only on a tip end of a finger portion on the exterior side of the palm side of the overglove.

* * * * *